United States Patent [19]

Morton, Jr.

[11] 4,071,233

[45] Jan. 31, 1978

[54] DOCUMENT HOLD-DOWN DEVICE

[75] Inventor: William David Morton, Jr., Mountain View, Calif.

[73] Assignee: Bourns, Inc., Riverside, Calif.

[21] Appl. No.: 748,088

[22] Filed: Dec. 6, 1976

[51] Int. Cl.[2] ..... B65H 5/36

[52] U.S. Cl. ..... 271/8 R; 271/184; 271/264

[58] Field of Search ..... 271/264, 266, 267, 275, 271/182, 270, 225, 229, 3, 8 R, 184, 220; 226/151; 198/836

[56] References Cited

U.S. PATENT DOCUMENTS

| | | | |
|---|---|---|---|
| 3,680,853 | 8/1972 | Houghton et al. | 271/3 |
| 3,869,117 | 3/1975 | Yoshimura | 271/182 X |
| 3,889,942 | 6/1975 | Robnolte | 271/3 |

FOREIGN PATENT DOCUMENTS

| | | | |
|---|---|---|---|
| 2,022,563 | 11/1971 | Germany | 271/220 |

*Primary Examiner*—Bruce H. Stoner, Jr.
*Attorney, Agent, or Firm*—Paul H. Ware; William G. Becker

[57] ABSTRACT

The subject device prevents a moving document from lifting off a support deck. A plurality of stiffly resilient flaps extend from a frame close to the deck and are canted in the direction of card travel. Removable mounting blocks clamp the flaps to the frame, with opposed surfaces of adjacent blocks guiding the flaps in the proper orientation. An end flap may be extended in length for further document guidance.

2 Claims, 4 Drawing Figures

DOCUMENT HOLD-DOWN DEVICE

BACKGROUND OF THE INVENTION

This invention relates to document handling apparatus, and more particularly to a device for preventing a document from lifting off a support deck.

In systems which involve the physical transmission of documents such as data cards, it is important that the cards be held down against the support decks across which they are transported in order to prevent jamming or improper feeding into the system equipment. Also, in some systems the card may undergo a 90° change in direction, with a stop wall used to halt forward card travel and to guide the card in the new direction. In this latter type of system any hold-down device employed near the stop wall must permit the desired change in direction, yet ideally the device should also prevent the card from reversing direction by bouncing back off the stop wall.

Various hold-down devices have been employed in the prior art. For example, a bank of balls may be mounted just over the support deck, with a limited amount of vertical movement permitted for each ball. As a card is transported beneath the bank the balls prevent any significant upward card movement, and in so doing only a relatively small amount of friction is produced between the balls and the card. While this type of device is effective in holding the card down, it is fairly noisy in operation and is also somewhat expensive.

Other devices are described in various United States patents. In U.S. Pat. No. 3,070,366 to Huck et al, cards are passed under spring-biased stops which keep the cards from retreating during subsequent processing. As indicated in the drawings, the stop is a rigid member which is spring-biased at an oblique angle down against a card support deck. In U.S. Pat. No. 3,276,772 to Spika a single, very light leaf spring is used to urge the cards downward toward the seat of a punching die. The leaf spring laps over the cards and acts as a break to hold it against movement during the punching operation. In U.S. Pat. No. 3,311,370 to Hunter and No. 3,156,463 to Masterson et al, a series of resilient pusher blades are held against a support surface and moved in a reciprocating fashion to advance an underlying card by pushing against its trailing edge. While designed primarily to move the cards, the devices described in these latter two patents also perform a hold-down function.

While each of the above patents discloses a device capable of preventing cards from lifting off a support deck, they are all subject to some improvement in terms of either holding down the entire length of the card, reducing the dynamic friction acting against the card, or being adaptable for use at different locations in a document transport system.

SUMMARY OF THE INVENTION

The object of the present invention is the provision of a novel and improved mechanism for holding documents such as data cards down against a support deck as they are transported across the deck. It is desired to achieve this object with a hold-down device that is inexpensive and quiet in operation, and which prevents cards from reversing their direction of travel while permitting their direction to be shifted by 90°. It is also an object to provide a card hold-down device which can be conveniently and inexpensively modified and adapted for different usage requirements.

These objects are achieved by means of a document hold-down device which employs a frame member and a plurality of stiffly resilient flaps mounted to the frame member at spaced intervals along the axis of document travel. The flaps are disposed in generally parallel planes intersecting the document plane along intersection lines which are generally orthogonal to the axis of document travel. Mounting blocks clamp the end portion of the flaps against the frame and guide the remainder of the flaps in a direction generally toward the document plane and canted in the direction of document travel.

In a preferred embodiment the mounting blocks are removable from the frame member and each flap is held between a pair of adjacent mounting blocks and guided with respect to the support deck by opposed guide surfaces on the two blocks. Mounting blocks other than the two end blocks are provided on opposite sides with a pair of guide surfaces, each employed in connection with a separate flap. The flaps preferably terminate near the surface of the support deck to achieve a combination of good hold-down characteristics together with a relatively low wiping friction against the cards. In addition, the flap at one end of the device may be elongated in order to achieve additional card guidance when interfacing with other parts of the card transport system, such as a drive roller assembly.

DESCRIPTION OF THE DRAWINGS

Further advantages and features of the invention will be apparent to those skilled in the art from the ensuing detailed description thereof, taken together with the accompanying drawings, in which.

DETAILED DESCRIPTION OF A PREFERRED EMBODIMENT

Figure 1:
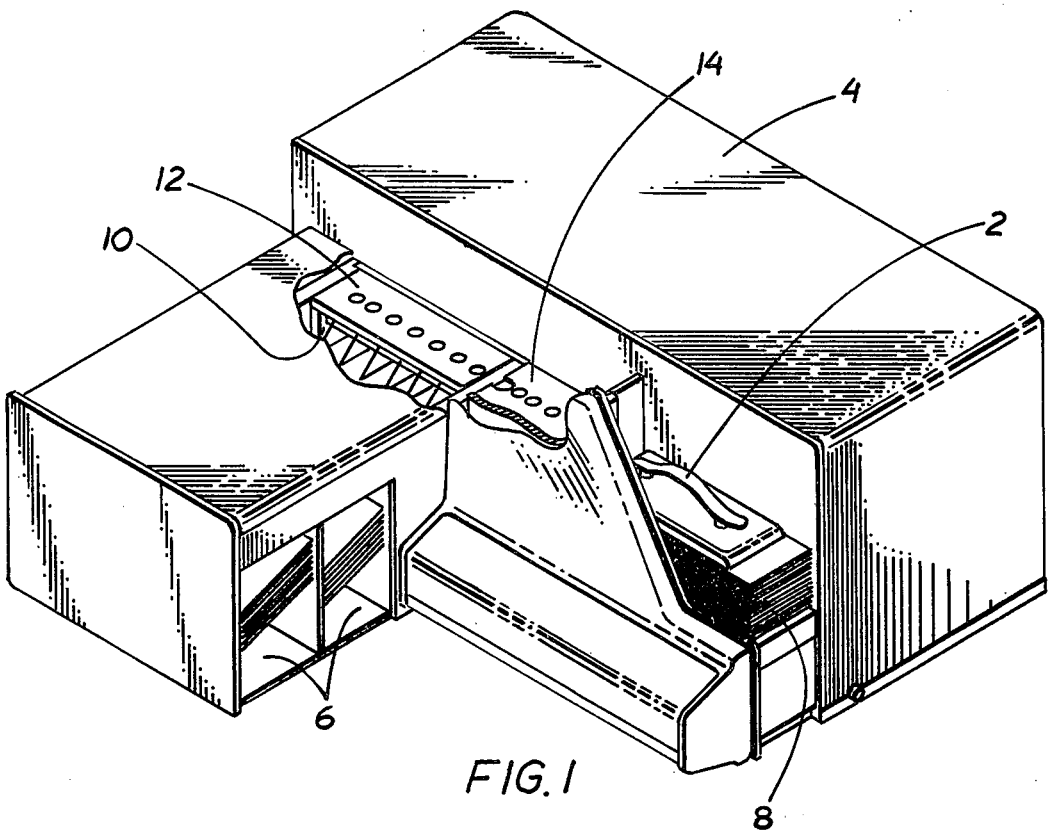
FIG. 1 is a perspective view of a data card reader/-sorter employing a pair of hold-down devices constructed in accordance with the invention.

In many document handling devices it is important to keep moving documents flat against a support deck, at least at selected points within the device, so that the documents may be properly guided into various processing stations. One such device, a data card reader/-sorter, is illustrated in FIG. 1. It includes a card hopper 2, a housing 4 for electronic and mechanical control mechanisms, and a plurality of output bins 6 among which the cards are distributed after being read and sorted. Data cards 8 are stacked in the hopper and drawn off one at a time from the bottom, following a straight line axis of travel until striking a guard wall 10. At this point they undergo a 90° change of direction and are distributed among sorting bins 6. The cards are moved by drive roller assemblies, and must be kept substantially flat against a support deck during transit through the reader/sorter to avoid jamming against the roller assemblies or other parts of the machine. For this purpose a pair of hold-down devices 12 and 14 are provided on either side of a drive roller assembly (shown in FIGS. 3 and 4), hold-down device 12 terminating just before guard wall 10.

Hold-down device 14 is shown in detail in FIG. 1. Device 12 employs a somewhat different construction, but it should be understood that both devices are included within the scope of the present invention, and that one of the advantages of the invention is the ability to conveniently modify its construction according to the requirements of its particular application. The hold-down device includes a support frame member 16, a plurality of stiffly resilient flaps 18, a plurality of mounting blocks 20, and a plurality of screws 22 which attach the mounting blocks to the frame with the flaps clamped in between. For this purpose frame 16 and flaps 18 are provided with smooth screw holes, while mounting blocks 20 each have a threaded screw hole.

Frame 16 is a metallic plate with a fixture 24 at one end for mounting to the reader/sorter. Flaps 18 are preferably formed from a plastic film such as a 0.01 inch layer of film produced by E. I. Du Pont de Nemours and Company under the trademark MYLAR. Each flap 18 is formed from a sheet bent such that its upper portion 18*a* can lie flat against the underside of frame 16 with its lower portion 18*b* depending from the frame at an obtuse angle to upper portions 18*a*.

Mounting blocks 20 are preferably plastic members each having a flat upper surface 20*a* which align with upper flap portions 18*a* to clamp the flaps against frame 16 when the mounting blocks are screwed to the frame. The lateral mounting block surfaces 20*b* are canted away from clamping surfaces 20*a* at the same angle as the angle between the upper and lower portions of flaps 18 and serve to guide the lower flap portions at that angle. In the final assembly each pair of adjacent mounting blocks 20 embrace a flap between their adjacent guide surfaces 20*b*, with the outer blocks each guiding a single flap and the intermediate blocks each guiding a pair of flaps, one on each lateral side. It is therefore necessary that both lateral sides of the intermediate blocks be canted at the desired angle, while only the inward facing lateral side of the outer blocks must be canted.

Figure 2:
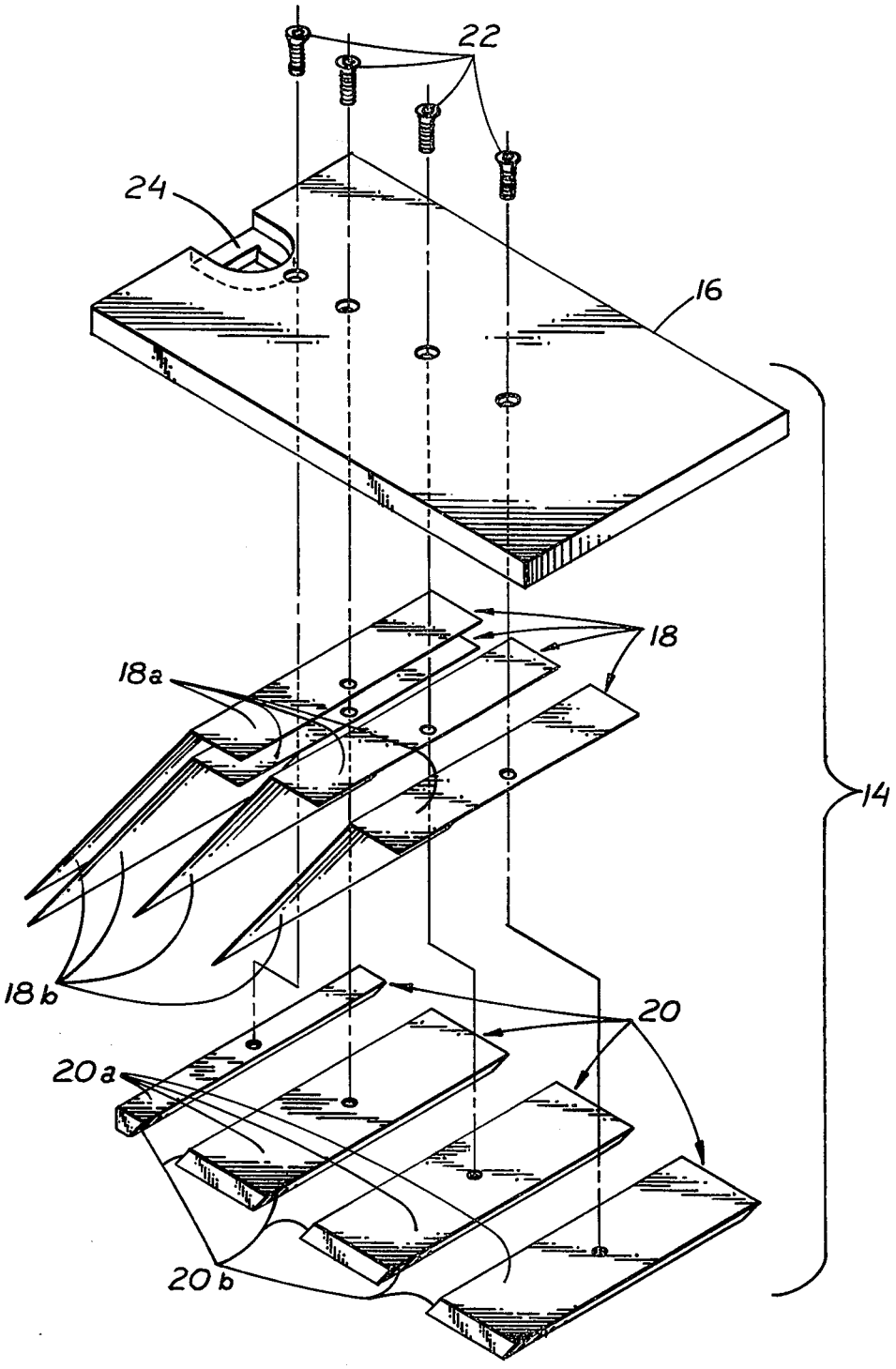
FIG. 2 is an exploded isometric view of one of the document hold-down devices from FIG. 1.

The hold-down device thus described may be readily modified by providing space on frame 16 for additional flaps and mounting blocks, and adding or subtracting the same as required. Also, different flaps may be used at different locations on the frame, and one type of flap may be substituted for another merely by unscrewing the appropriate mounting block from the frame, removing the existing flap, replacing it with one of the desired type, and then remounting the block with the new flap clamped in place. For example, a special flap construction is employed for the left-most flap station in FIG. 2 to provide extra guidance for the leading edge of a data card transported under the hold-down device. Two flaps are used at this station for added stiffness, and are made longer than the other flaps to assist in guiding the card.

Figure 3:
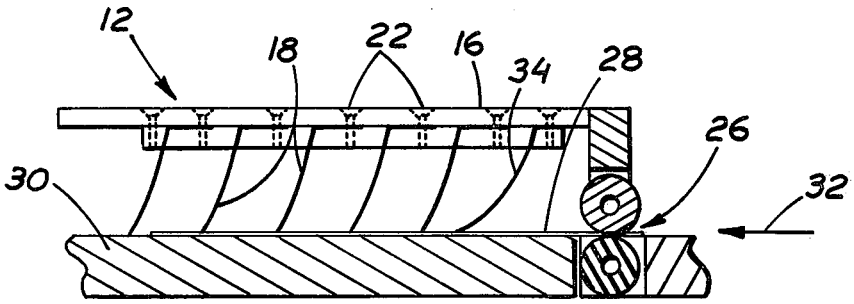
FIGS. 3 and 4 are elevation views in cross-section of hold-down devices employed respectively on the output and input sides of a drive roller assembly.

The use of hold-down device 12 on the output side of a drive roller assembly 26 is illustrated in FIG. 3. A data card 28 is shown being driven by the rollers onto a support deck 30 beneath the hold-down device, which is mounted to the reader/sorter frame. The flaps 18 are distributed at spaced intervals on frame 16 along the axis of card travel, indicated by an arrow 32 at the right of the card, and depend from the frame along generally parallel planes which emerge from the page. The flaps are canted in the direction of card travel and intersect the card plane along intersection lines which are generally orthogonal to the axis of card travel. All but the right-most flap extend approximately to the support deck, preferably terminating just above the deck so that card 28 is wiped just enough to hold it down with only a small amount of frictional drag as it passes from right to left under the flaps. The right-most flap 34 is made longer than the other flaps in order to counteract the tendency of the leading card edge to bend upward as it emerges from between the rollers.

Hold-down device 12, which is located just before guard wall 10 in the reader/sorter, offers other advantages in addition to its ability to prevent the card from lifting off the support deck. While it produces only a small amount of frictional drag on a card moving from right to left, it strongly opposes any card movement from left to right and thus effectively prevents a card from bouncing back to any significant extent when it strikes wall 10. Although it does prevent a reversal of direction, device 12 does not present any significant resistance to lateral card movement at a 90° direction from the original axis of travel for conveyance of the cards to output bins 6. It should also be noted that device 12 employs six flap stations, as opposed to only three for the device shown in FIG. 2. The expanded number of stations enables a greater portion of card 28 to be held down when its direction of travel is shifted.

Figure 4:
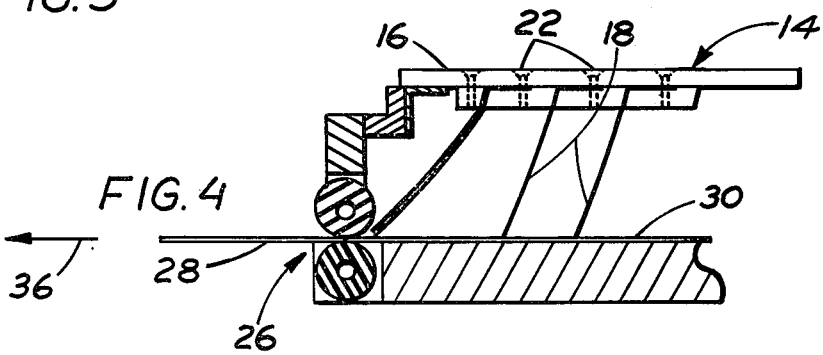

FIG. 4 shows hold-down device 14 in position for guiding a card 28 into drive roller assembly 26 along an axis of travel indicated by arrow 36. It will be noticed that the extended double flap on the left-hand side of the device extends almost to the drive roller assembly and guides the leading card edge between the rollers.

A document hold-down device has thus been shown and described which effectively prevents a moving document from lifting off a support deck, and is both quiet in operation and inexpensive. In addition, it prevents the document from reversing its direction while permitting it to undergo a 90° direction shift, and can be easily modified in terms of both its overall dimensions and the force of contact established with the document. While particular embodiments of the invention have been shown, numerous additional applications and variations are possible in light of the above teachings. It is therefore intended that the scope of the invention be limited only in and by the terms of the appended claim.

What is claimed is:

1. In a device for holding a generally flat moving document against a support deck, having a frame member adapted to be positioned above a document plane and oriented to the axis of document travel with a plurality of stiffly resilient hold-down flaps formed from a plastic film, and including means for mounting said hold-down flaps to said frame member at spaced intervals along the axis of document travel comprising a plurality of mounting blocks associated respectively with each of said hold-down flaps, wherein all but an end one of said flaps depends from said frame member by substantially equal lengths, and said end one of said hold-down flaps is longer than the other flaps, the improvement wherein:

said frame member and mounting blocks include mutually aligned screw holes and said mounting blocks are attached to said frame member by screws extending thereinto through said frame member;

a pair of mounting blocks are associated with each of said hold-down flaps, the blocks of each pair having mutually opposed parallel guide surfaces to guide their associated hold-down flap therebetween; and said mounting blocks are being arranged with two end blocks and at least one intermediate block, each of said intermediate blocks including guide surfaces along opposite sides cooperating with immediately adjacent blocks to guide a pair of flaps, one at each side.

2. In a device for holding a generally flat moving document against a support deck, having a frame member adapted to be positioned above a document plane and oriented to the axis of document travel with a plurality of stiffly resilient hold-down flaps formed from a plastic film, and including means for mounting said hold-down flaps to said frame member at spaced intervals along the axis of document travel comprising a plurality of mounting blocks associated respectively with each of said hold-down flaps, wherein all but an end one of said flaps depends from said frame member by substantially equal lengths, and said end one of said hold-down flaps is longer than the other flaps, the improvement wherein:

said frame member and mounting blocks include mutually aligned screw holes and said mounting blocks are attached to said frame member by screws extending thereinto through said frame member;

a pair of mounting blocks are associated with each of said hold-down flaps, the blocks of each pair having mutually opposed parallel guide surfaces to guide their associated hold-down flap therebetween; and said mounting blocks being arranged with two end blocks and at least one intermediate block, each of said intermediate blocks including guide surfaces along opposite sides cooperating with immediately adjacent blocks to guide a pair of flaps, one at each side, and further including at least one additional flap overlying an end one of said hold-down flaps and clamped to the frame member by the same mounting block for said end flap.

* * * * *

UNITED STATES PATENT OFFICE

CERTIFICATE OF CORRECTION

Patent No. 4,071,233 Dated January 31, 1978

Inventor(s) William David Morton, Jr.

It is certified that error appears in the above-identified patent and that said Letters Patent are hereby corrected as shown below:

Column 2, Line 67: "FIG. 1" should read -- FIG. 2 --

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*